US008528159B2

(12) United States Patent
Lee

(10) Patent No.: US 8,528,159 B2
(45) Date of Patent: Sep. 10, 2013

(54) STEAM CLEANER WITH SEAL FLAP

(76) Inventor: Kyu Lee, La Canada, CA (US)

( * ) Notice: Subject to any disclaimer, the term of this patent is extended or adjusted under 35 U.S.C. 154(b) by 132 days.

(21) Appl. No.: 13/373,318

(22) Filed: Nov. 12, 2011

(65) Prior Publication Data

US 2013/0117960 A1 May 16, 2013

(51) Int. Cl.
*A47L 11/34* (2006.01)

(52) U.S. Cl.
USPC ..... 15/322; 15/320

(58) Field of Classification Search
USPC ..... 15/320–322, 415.1, 401, 422.1, 420
See application file for complete search history.

(56) References Cited

U.S. PATENT DOCUMENTS 1,050,989 A * 1/1913 Niuffer ..... 15/415.1
1,413,545 A * 4/1922 Throop ..... 15/354
2,908,933 A 10/1959 Todd, Jr. et al
3,262,146 A * 7/1966 Hays ..... 15/321
4,654,925 A * 4/1987 Grave ..... 15/322
4,875,249 A * 10/1989 Collier ..... 15/398
5,077,863 A * 1/1992 Rench ..... 15/384
RE34,325 E 7/1993 Rau et al.
5,613,271 A * 3/1997 Thomas ..... 15/321
5,891,198 A * 4/1999 Pearlstein ..... 8/158
7,171,722 B2 * 2/2007 Keller ..... 15/322
7,870,639 B2 * 1/2011 Thomas ..... 15/322

* cited by examiner

*Primary Examiner* — Mark Spisich
*Assistant Examiner* — Andrew A Horton

(57) ABSTRACT

The steam cleaner with seal flap comprises a handle assembly further comprising a sprayer tube that channels pressured water to a sprayer nozzle to spray the pressured water to the area or surface to be treated and a collector tube channeling the used water back to the main unit where the used water is stored in a storage tank; a collector head assembly, located at a free end of the collector tube of the handle assembly, collecting the used water from the treated surface through a vacuum aperture at the lower end with a vacuum aperture edge being a pressure seal; and a seal flap movably attached to the head assembly to provide a secondary seal cover to preserve vacuum pressure in case the vacuum aperture edge is lifted from the floor surface. The seal flap also guides the water spray onto to the target surface area.

8 Claims, 3 Drawing Sheets

STEAM CLEANER WITH SEAL FLAP

CROSS-REFERENCES TO RELATED APPLICATIONS

N/A

BACKGROUND OF THE INVENTION

1. Field of the Invention

This invention relates generally to cleaning equipment for treating surface area using a compressor, pressured water, and a water heating means. More particularly, it is related to the seal at the vacuum intake of the head assembly that makes contact with the treated surface area. The seal is placed to help the user hold the handle easily without trying to keep it at a certain angle respect to the ground level.

2. Description of Related Art Including Information Under 37 CFR 1.97 and 1.98

A number of different seal designs have been introduced in the field. U.S. Pat. No. 2,908,933 to Todd, Jr. introduces a disposable sanitary members formed of flexible material such as paper or the like adapted to be inserted to a head member connected to a source of vacuum. The head member is adapted to readily receive and retain the sanitary members in a novel way whereby force exerted by air entering the apparatus constantly urges retention of a sanitary member in the head member. RE. 34,325 to Rau reveals an adapter, mounted on the cylindrical sidewall of the vacuum cleaner tank, providing a receptacle for a rigid connector on which a flexible vacuum hose is sealingly mounted. The leading edge of the connector insert is beveled. A corresponding beveled surface is formed on the inner wall of the receptacle to engage and seal with the beveled leading edge of the connector to form a continuous, peripheral seal to the wall of the tank.

SUMMARY OF THE INVENTION

The present invention teaches certain benefits in construction and use which give rise to the objectives described below.

The main steam cleaner unit usually comprises a compressor or an equivalent to create vacuum pressure and the vacuum pressure is directed to a first flexible tube means such as a hose, to a collector tube of a handle assembly, and to a vacuum collector head with an opening at the free end that collects used water on the floor. The collected water is routed back to the main steam cleaner unit in which a collector tank is usually placed to store the used water. The main unit also heats up and supplies fresh water usually mixed with a detergent through a second flexible means to a sprayer tube and eventually to a nozzle at the free end of the sprayer tube. When the water is sprayed on the surface area to be treated, a user moves the vacuum collector head toward the treated area to recollect the water back to the main unit. The open slot or opening of the vacuum collector head facing the floor must stay in full contact with the floor or sealed on the floor to keep the vacuum pressure strong enough to bring in the used water from the floor. However it is difficult for most users to keep the vacuum collector head at a perfect angle the whole time the unit is being used. For this reason a seal flap is installed on the vacuum collector head to provide sealing effect even if the vacuum head is not perfectly flat with the surface. The seal flap is movably attached to the collector head, moves along the surface of the collector head, and makes a contact with the floor all the time while the unit is being used; this way, when the collector head is making an angled contact with the floor with a gap the seal flap covers the gap to maintain the vacuum pressure to collect the used water.

A primary objective of the present invention is to provide a system having advantages not taught by the prior art.

Another objective is to provide such a device that provides an effective way to keep the suction pressure to bring in used water at the vacuum collector head.

Another objective is to provide such a system that provides a simple structure to direct the spray of water on to the target surface area.

Another objective is to provide such a system that is easy to use for a user when using the handle assembly by providing an automatic adjustment on seal flap.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
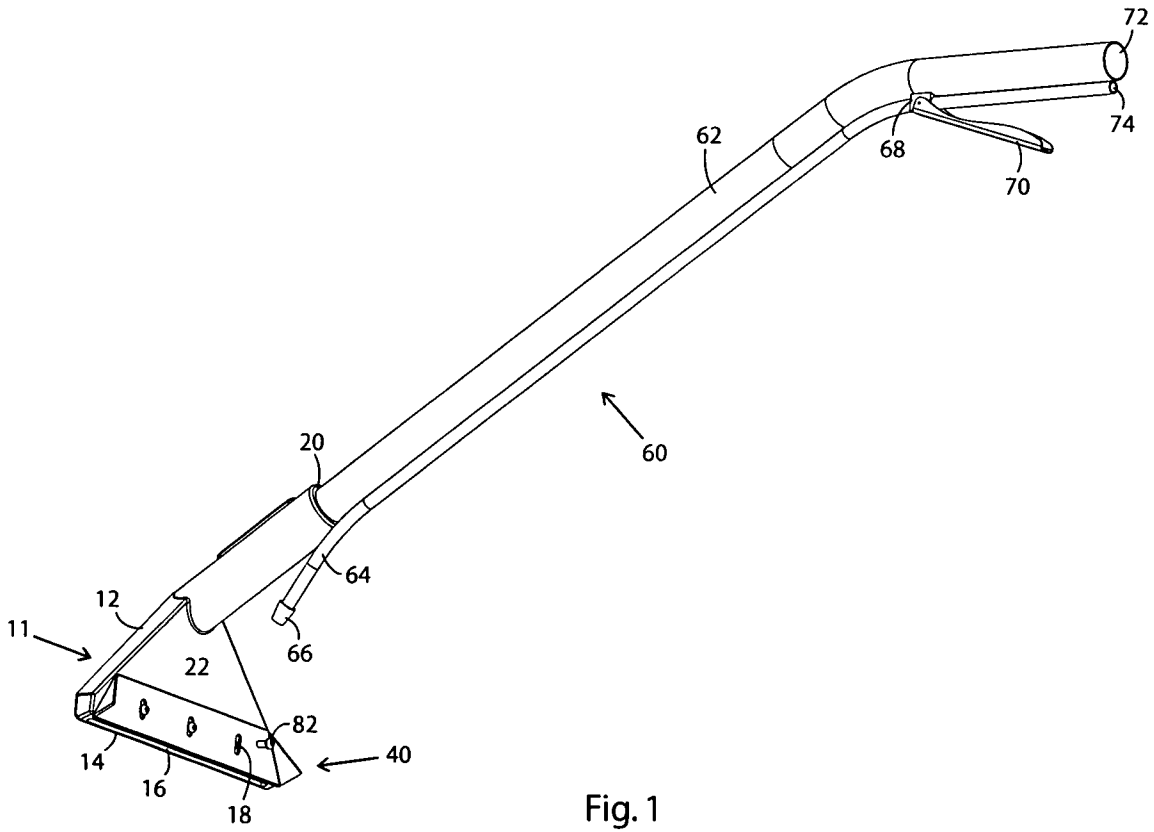
FIG. 1 is a left perspective view of a handle assembly, a collector head, and a seal flap.
Figure 2:
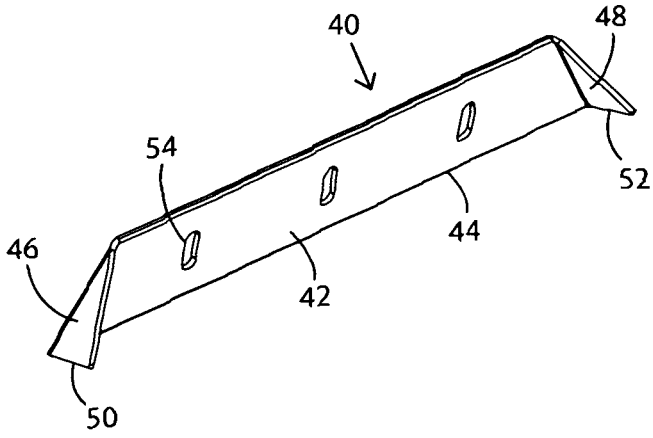
FIG. 2 is a left perspective view of the seal flap.

The above described drawing FIGS. 1 through 4 illustrates the invention, a steam cleaner with seal flap 10, comprising a collector head assembly 11, a seal flap 40, handle assembly 60, and a main steam cleaner unit 100. One end of handle assembly 60 is connected to a pair of hose lines 84 from the main steam cleaner unit, and the other end of handle assembly 60 is attached to collector head assembly 11. Seal flap 40 is movably attached to collector head assembly 11.

Collector head assembly 11 comprises a collector head body 12 that has a vacuum aperture 16 defined and surrounded by a vacuum aperture edge 14 at the lower end facing a floor surface 80. Vacuum aperture 16 continuously extends to the top side of collector head body 12 where a collector top aperture 20 is placed to receive a handle assembly 60. Collector head body 12 encloses vacuum chamber inside collector head assembly 11, like a duct, to maintain the pressure between vacuum aperture 16 at the bottom side and collector top aperture 20 at the top. Collector head assembly 11 further comprises a set of screw mounting holes 18 on a surface substantially orthogonal to the bottom end surface defined by vacuum aperture edge 14, such as a vertical surface 22 shown in FIG. 1. Vacuum aperture 16 surrounded by vacuum aperture edge 14 shown in the embodiment in FIGS. 1-3 looks like a long elongated slot, but is not limited to the slot-like shape but can be a round opening, a rectangular opening, or even a triangular shape as long as the vacuum suction power is enough for the size of the opening.

Seal flap 40 is movably attached to collector head assembly 11 on vertical surface 22 by a set of screws 82 into screw mounting holes 18 on vertical surface 22 of the head assembly. The screws are not tightened against seal flap 40 such that seal flap 40 can move along vertical surface 22. Seal flap 40 comprises a flap body 42, a flap bottom edge 44 at the lower end of the flap body, a left guard 46 and a right guard 48 providing a surface area to direct water stream or spray to the target area being treated, and a set of elongated holes 54 to receive mounting screws 82. In the embodiment shown in FIGS. 1-4, left guard 46 on the left side of flap body 42 and right guard 48 on the right side of the flap body are simply bent corners of flat material of flap body 42, but they could be in other forms such as an attached part at each side as long as they have a surface area to direct the water stream on to the target area on the floor. Here elongated holes 54 of seal flap 40 are used to mount seal flap 40 on collector head body 12 using screws 82. When screws 82 are inserted through elongated holes 54 and into mounting holes 18, the screws are tightened against collector head body 12 but not tightened against seal flap 40 so that seal flap 40 has free movement in the direction of the major diameter of elongated holes 54 along the mounting surface on the head body. An alternative to elongated holes 54 to provide such free movement of seal flap 40 is a pair of tracks on the head body for seal flap 40 to ride on in the direction of the movement or a pair of holder bars attached to the head body and retain seal flap adjacent to the head body or other mechanical means to provide such motion can be employed for the same purpose.

Collector top aperture 20 of collector head assembly 11 is connected to handle assembly 60 comprising a collector tube 62 that is basically a tube to direct vacuum pressure to the head assembly with the main steam cleaner unit providing the pressure, a sprayer tube 64 that is another tube, adjacent to and along the collector tube, directing water to a sprayer nozzle 66 at a free end of sprayer tube 64 placed near and directed to the head assembly, a sprayer valve 68 which upon opening its orifice releases water through sprayer nozzle 66, and a sprayer lever 70 placed on or near valve 68 to open the valve by a pulling or pushing action. Collector outlet 72 is an opening at the end of collector tube 62, at the opposite side of the head assembly, and is connected to a first flexible tube means, such as a rubber hose or a plastic hose, that is also connected to the main steam cleaner unit. Sprayer inlet 74 is an opening at the end of sprayer tube 64, at the opposite side of the head assembly, and is connected to a second flexible tube means, such as a rubber hose, that is also connected to the main steam cleaner unit. The first flexible tube means and the second flexible tube means are the pair of hose lines 84 as represented as a line shown in FIG. 4.

Main steam cleaner unit 100 usually comprises a compressor or an equivalent to create vacuum pressure and the vacuum pressure is directed to the first flexible tube means such as a hose, to collector tube 62 of handle assembly 60, and to collector head assembly 11. At the bottom end of the head assembly is vacuum aperture 16 through which the used water is collected by the suction power of the vacuum pressure, and the collected water is routed back to the main steam cleaner unit in which possibly a collection tank is placed. The main unit also heats up and supplies water through the second flexible means to sprayer tube 62 and eventually to nozzle 66 at the free end of the sprayer tube. The water is usually mixed with a detergent in the main unit to effectively remove the dirt from the surface area being treated. When the water is sprayed on to the surface area to be treated, a user moves vacuum aperture 16 of the head assembly toward the treated area to recollect the water back to the main unit.

Figure 3:
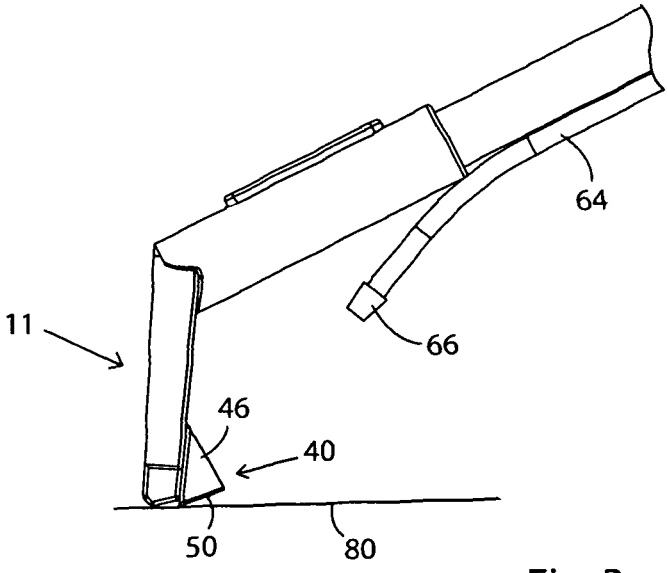
FIG. 3 is a left plan view of the head assembly with the seal flap touching the ground.
Figure 4:
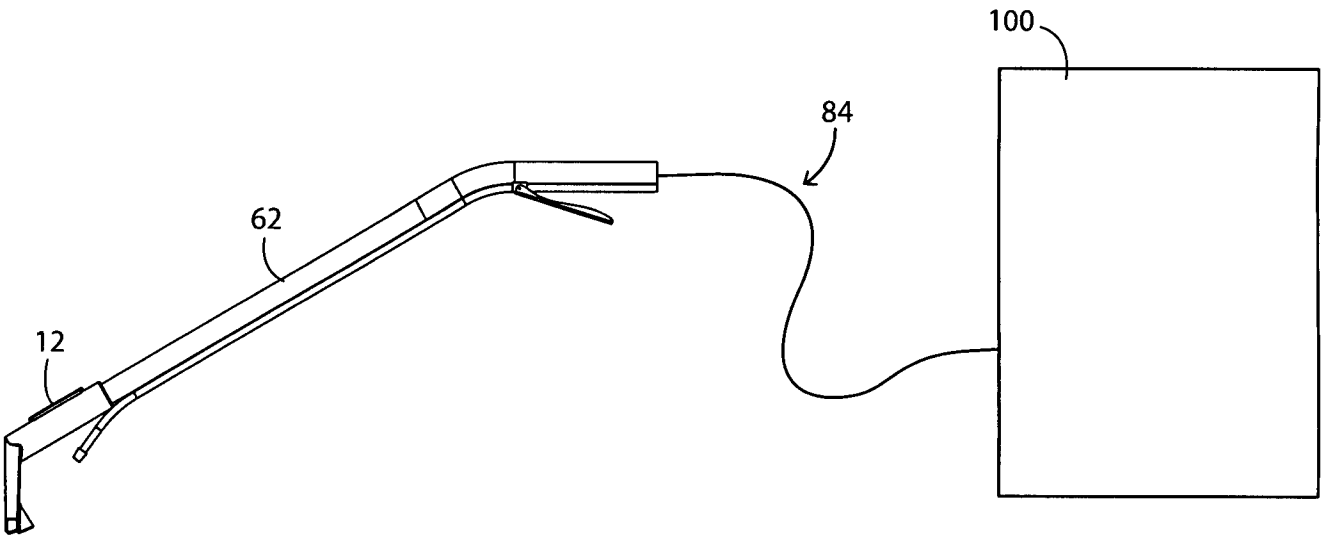
FIG. 4 is shows the head assembly, the handle assembly, the main steam cleaner unit, and a line representing a pair of hoses connecting the handle assembly and the main cleaner unit.

The user holds handle assembly 60 and puts vacuum aperture 16 of head assembly 11 against the floor surface and actuates sprayer lever 70 to open sprayer valve 68 and to spray water through nozzle 66 onto the surface. To maintain a good vacuum pressure at the vacuum aperture, vacuum aperture 16 or vacuum aperture edge 14 should be flat against the floor surface to allow water to come into vacuum aperture 16. So the user must hold the handle assembly at the optimum angle from the surface to keep such position, but it is difficult to maintain such position all the time while the unit is being used. For this reason, seal flap 40 is installed on collector head assembly 11 adjacent to vacuum aperture edge 14 to provide a secondary seal edge for the vacuum pressure against the floor. When vacuum aperture 16 or vacuum aperture edge 14 is not flat against the floor surface and the side near nozzle 66 is lifted up from the floor as shown in FIG. 3, seal flap 40 naturally comes down and makes a contact with the floor to help maintaining vacuum pressure under vacuum aperture 16. Even though seal flap makes contact with the floor the water on the floor passes under the seal flap because of the characteristics of surface tension that water exhibits when the surface is wet or water basically tends to stick to the surface with a certain force. Seal flap 40 is relatively light in weight so it does not push away water from the treated surface area and yet provides a sufficient seal for the vacuum pressure. A left guard bottom edge 50 under left guard 46 and a right guard bottom edge 52 under right guard 48 are angled such that the main part or the middle part of seal flap is in contact with the surface when the head assembly is in the position of being used. From the side view shown in FIG. 3, the angled bottom edges 50, 52, should not touch the floor surface such that the outer most part or tip of each of the left guard and the right guard does not touch the floor surface while the collector head assembly is in a proper position of being used.

Seal flap 40 may also be installed on the outer surface, the flat side facing away from spray nozzle 66, of collector head assembly 11. Or two seal flaps can be installed simultaneously: One flap on the surface head assembly 11 facing the spray nozzle as shown in FIG. 1 and another flap on the outer surface facing away from the spray nozzle.

Although the invention has been disclosed in detail with reference only to the embodiments shown and described above, those skilled in the art will appreciate that various other embodiments can be provided without departing from the scope of the invention. Accordingly, the invention is defined only by the claims set forth below.

The invention claimed is:

1. A steam cleaner machine comprising:

a. a main steam cleaner unit supplying pressured water for cleaning or treating a surface area and receiving the used water back to store in a collection tank, b. a handle assembly further comprising a sprayer tube having a first open end and a second open end, wherein the sprayer tube receives the pressured water from the main steam cleaner unit at the first open end and channels the water to the second open end where a sprayer nozzle is placed to spray the pressured water to the area or surface to be treated, and a collector tube having a first end and a second end, wherein the collector tube receives the used water at the second end and channels the used water to the first end toward the main steam cleaner unit, c. a collector head assembly, mounted or located at the second end of the collector tube of the handle assembly, further comprising a collector head body having a lower open end as a vacuum aperture and a top open end as a collector top aperture, wherein the used water is collected through, first, the vacuum aperture and the collector head body acts a duct channeling the used water up to the collector top aperture where the collector tube is mounted to further channel the used water toward the main unit, d. a seal flap, movably mounted on a vertical surface of the collector head assembly, which faces the sprayer tube, to freely move vertically in a generally linear manner, further comprising a flap body with a flap bottom edge at the lower end of the flap body to make contact with the floor surface while the main unit is being used, a left guard and a right guard to guide the sprayed water from the nozzle on to the area or the surface to be treated, wherein the seal flap provides a secondary seal to preserve the vacuum pressure when the vacuum aperture or a vacuum aperture edge surrounding the vacuum aperture of the collector head assembly is not flat against the floor surface.

2. The steam cleaner machine of claim 1, further comprising: a left guard bottom edge under the left guard of the seal flap and a right guard bottom edge under the right guard of the seal flap, wherein the left guard bottom edge and the right guard bottom edge are angled such that the outer most part or tip of each of the left guard and the right guard does not touch the floor surface while the collector head assembly is in a proper position of being used.

3. The steam cleaner machine of claim 1, further comprising: a sprayer valve on the sprayer tube of the handle assembly to hold or release the pressured water to the sprayer nozzle, and a sprayer lever that actuates the sprayer valve.

4. The steam cleaner machine of claim 1, further comprising: a set of elongated holes in the seal flap and a set of screws to hold the seal flap in place and allow the seal flap to move freely in a vertical direction to provide a sealing effect in case that the vacuum aperture edge of the head assembly is not flat against the floor surface.

5. A steam cleaner machine comprising:

a. a handle assembly further comprising a sprayer tube having a first open end and a second open end, wherein the sprayer tube receives the pressured water from a source at the first open end and channels the water to the second open end where a sprayer nozzle is placed to spray the pressured fresh water to the area or surface to be treated; and a collector tube having a first end and a second end, wherein the collector tube receives the used water at the second end and channels the used water to the first end where the used water exits to be collected, b. a collector head assembly, mounted or located at the second end of the collector tube of the handle assembly, further comprising a collector head body having a lower open end as a vacuum aperture and a top open end as a collector top aperture, wherein the used water is collected through, first, the vacuum aperture and the collector head body acts a duct channeling the used water up to the collector top aperture where the collector tube is mounted to further channel the used water, c. a seal flap, movably mounted on a vertical surface of the collector head assembly, which faces the sprayer tube, to freely move vertically in a generally linear manner, further comprising a flap body with a flap bottom edge at the lower end of the flap body to make contact with the floor surface and a left guard and a right guard to guide the sprayed water from the nozzle on the area or the surface to be treated, wherein the seal flap provides a secondary seal to preserve the vacuum pressure when the vacuum aperture or a vacuum aperture edge surrounding the vacuum aperture of the collector head assembly is not flat against the floor surface.

6. The steam cleaner machine of claim 5, further comprising: a left guard bottom edge under the left guard of the seal flap and a right guard bottom edge under the right guard of the seal flap, wherein the left guard bottom edge and the right guard bottom edge are angled such that the outer most part or tip of each of the left guard and the right guard does not touch the floor surface while the collector head assembly is in a proper position of being used.

7. The steam cleaner machine of claim 5, further comprising: a sprayer valve on the sprayer tube of the handle assembly to hold or release the pressured water to the sprayer nozzle, and a sprayer lever that actuates the sprayer valve.

8. The steam cleaner machine of claim 5, further comprising: a set of elongated holes in the seal flap and a set of screws to hold the seal flap in place and allow the seal flap to move freely in a vertical direction to provide a sealing effect in case that the vacuum aperture edge of the head assembly is not flat against the floor surface.

* * * * *